US011307515B2

(12) United States Patent
Kikuchi et al.

(10) Patent No.: US 11,307,515 B2
(45) Date of Patent: Apr. 19, 2022

(54) DEVELOPING DEVICE WITH A DEVELOPER REGULATOR AND A STOPPER

(71) Applicant: Ricoh Company, Ltd., Tokyo (JP)

(72) Inventors: Hiroshi Kikuchi, Kanagawa (JP); Akira Fujimori, Kanagawa (JP); Hideki Kimura, Kanagawa (JP); Yutaka Takahashi, Kanagawa (JP); Johji Yahagi, Kanagawa (JP); Hiroyuki Uenishi, Kanagawa (JP); Yusuke Ishizuka, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/923,410

(22) Filed: Jul. 8, 2020

(65) Prior Publication Data

US 2021/0033998 A1 Feb. 4, 2021

(30) Foreign Application Priority Data

Jul. 31, 2019 (JP) ..... JP2019-140512
Nov. 26, 2019 (JP) ..... JP2019-213089

(51) Int. Cl.
*G03G 15/08* (2006.01)
*G03G 15/09* (2006.01)

(52) U.S. Cl.
CPC ..... *G03G 15/0877* (2013.01); *G03G 15/081* (2013.01); *G03G 15/0891* (2013.01);
(Continued)

(58) Field of Classification Search
CPC ..... G03G 15/0877; G03G 15/09; G03G 15/0891; G03G 15/0921; G03G 15/0812;
(Continued)

(56) References Cited

U.S. PATENT DOCUMENTS

2010/0202805 A1* 8/2010 Miyoshi ..... G03G 15/0887 399/277
2012/0051797 A1 3/2012 Suzuki et al.
(Continued)

FOREIGN PATENT DOCUMENTS

JP 2012-108466 6/2012
JP 2013-246276 12/2013
JP 2015-022118 2/2015

*Primary Examiner* — Walter L Lindsay, Jr.
*Assistant Examiner* — Laura Roth
(74) *Attorney, Agent, or Firm* — Xsensus LLP

(57) ABSTRACT

A developing device includes a developer bearer, a developer regulator, a developer supply passage, and a stopper. The developer bearer includes a magnetic field generator and is configured to bear a developer containing toner and magnetic carriers and conveys the developer to a developing area by rotation. A stopper prevents the developer blocked by the developer regulator from moving to a surface of the developer bearer, while securing a supply path for passing the developer in the developer supply passage to the developer bearer between the stopper and an upper end of a side wall of the developer supply passage that is opposite to the developing bearer. A width of the supply path in a direction perpendicular to a direction of a rotation axis of the developer bearer is in a range of 7%-10% of a circumference of an outer diameter of the developing bearer.

14 Claims, 6 Drawing Sheets

(52) U.S. Cl.
CPC ..... *G03G 15/09* (2013.01); *G03G 15/0921* (2013.01); *G03G 2215/0827* (2013.01)

(58) Field of Classification Search
CPC ..... G03G 15/081; G03G 2215/0827; G03G 2215/0609; G03G 2215/0641; G03G 2215/0813
See application file for complete search history.

(56) References Cited

U.S. PATENT DOCUMENTS

| | | | |
|---|---|---|---|
| 2013/0315636 | A1 | 11/2013 | Takayama et al. |
| 2014/0003843 | A1 | 1/2014 | Suzuki et al. |
| 2015/0023700 | A1 | 1/2015 | Nakamoto et al. |
| 2016/0170329 | A1 | 6/2016 | Kimura et al. |
| 2016/0202630 | A1 | 7/2016 | Okamoto et al. |
| 2016/0223946 | A1 | 8/2016 | Kikuchi et al. |
| 2017/0336733 | A1 | 11/2017 | Adachi et al. |
| 2019/0258199 | A1 | 8/2019 | Kimura |

* cited by examiner

DEVELOPING DEVICE WITH A DEVELOPER REGULATOR AND A STOPPER

CROSS-REFERENCE TO RELATED APPLICATIONS

This patent application is based on and claims priority pursuant to 35 U.S.C. § 119(a) to Japanese Patent Application Nos. 2019-140512, filed on Jul. 31, 2019, and 2019-213089, filed on Nov. 26, 2019, in the Japan Patent Office, the entire disclosure of each of which is incorporated by reference herein.

BACKGROUND

Technical Field

Aspects of the present disclosure relate to a developing device and an image forming apparatus including the developing device.

Related Art

Generally, there is known a developing device including a magnetic field generator and a developer bearer that bears a developer containing toner and magnetic carrier particles and conveys the developer to a developing area by rotation.

SUMMARY

In an aspect of the present disclosure, there is provided a developing device that includes a developer bearer, a developer regulator, a developer supply passage, and a stopper. The developer bearer includes a magnetic field generator and is configured to bear a developer containing toner and magnetic carriers and conveys the developer to a developing area by rotation. The stopper is configured to prevent the developer blocked by the developer regulator from moving to a surface of the developer bearer, while securing a supply path for passing the developer in the developer supply passage to the developer bearer between the stopper and an upper end of a side wall of the developer supply passage that is opposite to the developing bearer. A width of the supply path in a direction perpendicular to a direction of a rotation axis of the developer bearer is in a range of 7% or more and less than 10% of a circumference of an outer diameter of the developing bearer.

In another aspect of the present disclosure, there is provided a developing device that includes a developer bearer, a developer regulator, a developer supply passage, and a stopper. The developer bearer includes a magnetic field generator and is configured to bear a developer containing toner and magnetic carriers and conveys the developer to a developing area by rotation. The stopper is configured to prevent the developer blocked by the developer regulator from moving to a surface of the developer bearer, while securing a supply path for passing the developer in the developer supply passage to the developer bearer between the stopper and an upper end of a side wall of the developer supply passage that is opposite to the developing bearer. A width of the supply path in a direction perpendicular to a direction of a rotation axis of the developer bearer is in a range of 6% or more and 10% or less of a circumference of an outer diameter of the developing bearer, and a width of the stopper in the direction perpendicular to the direction of the rotation axis of the developer bearer is 6% or more and 11% or less of the circumference of the outer diameter of the developing bearer.

In still another aspect of the present disclosure, there is provided an image forming apparatus that includes the developing device according to any of the above-described aspects.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
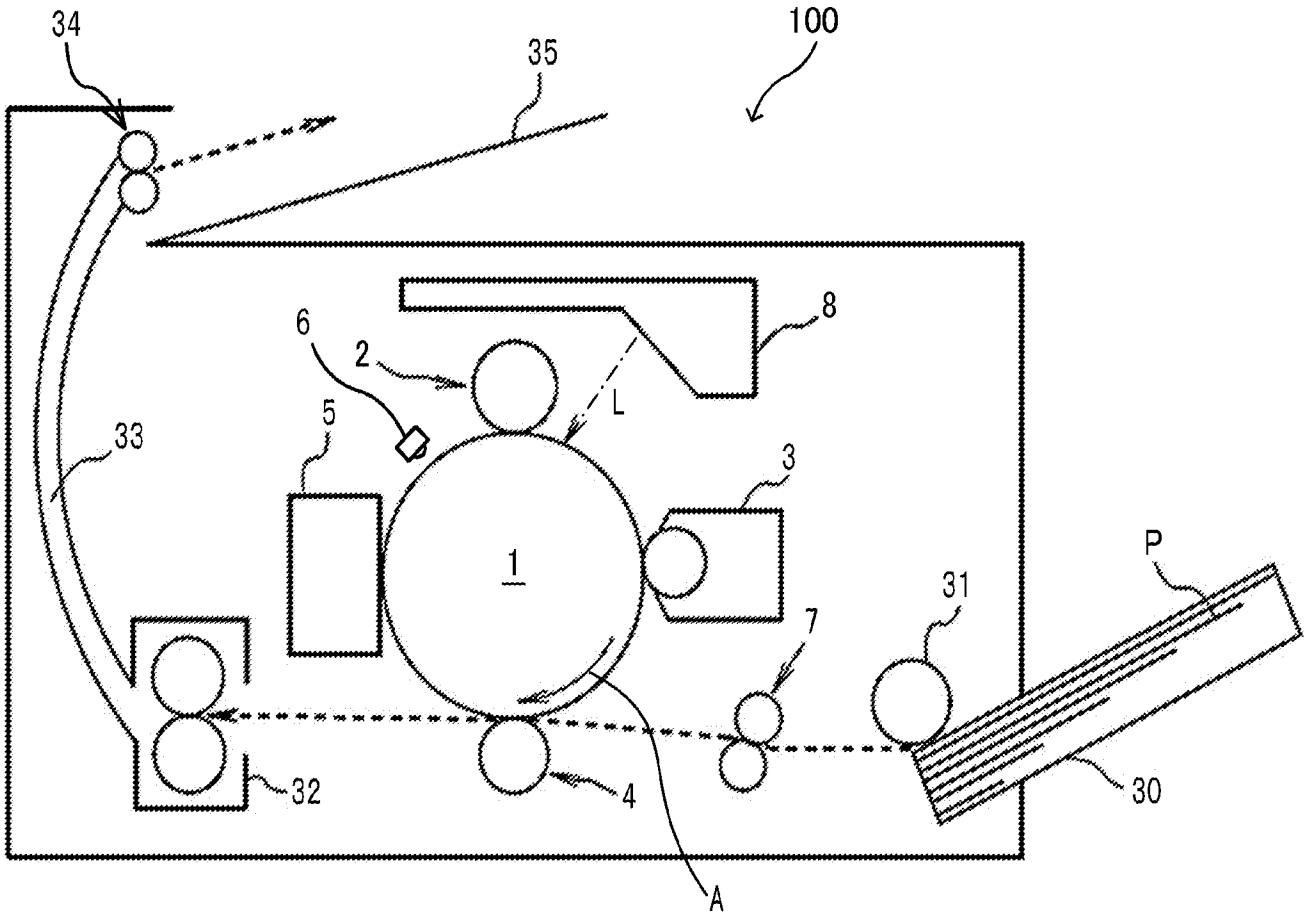
FIG. 1 is a schematic view illustrating a configuration of a printer according to an embodiment.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Below, a printer that forms an image by an electrographic method is described as an example of an image forming apparatus including a developing device according to an embodiment of the present invention. The printer described in the following embodiment is just an example of the image forming apparatus according to an embodiment of the present invention. Embodiments of the present invention are not limited to the printer but may be any other suitable type of image forming apparatus.

FIG. 1 is a schematic view illustrating a printer 100 as an example of an image forming apparatus according to an embodiment. The printer 100 in the present embodiment includes a drum-shaped photoconductor 1. The photoconductor 1 is driven by a driver to rotate in a (clockwise) direction indicated by arrow A in FIG. 1. Around the photoconductor 1, a charger 2 as uniform charging device, a developing device 3, a transfer device 4, a cleaner 5, and a discharger 6 are arranged. A registration roller pair 7 is arranged below the photoconductor 1 and an optical writing device 8 is arranged above the photoconductor 1. The printer 100 further includes a sheet tray 30, a feed roller 31, a fixing device 32, an output passage 33, an output roller pair 34, and an output tray 35.

The drum-shaped photoconductor 1 is uniformly charged by the charger 2. The photoconductor 1 is optically scanned by writing light L emitted from the optical writing device 8. Of the entire area of the surface of the photoconductor 1, the electric potential in an area(s) irradiated with the writing light L by the optical scanning is lowered, thus causing an electrostatic latent image to be borne on the area of the surface of the photoconductor 1.

The electrostatic latent image moves to a position opposite the developing device 3 with the rotation of the photoconductor 1. The developing device 3 develops the electrostatic latent image with toner at a position opposite the photoconductor 1 to form a toner image. Thus, with the rotation of the photoconductor 1, the developed toner image moves to a transfer area at which the photoconductor 1 faces the transfer device 4.

The printer 100 includes a sheet tray 30. The feed roller 31 contacts a recording sheet P as the uppermost transfer material of a sheet bundle accommodated in the sheet tray 30. The registration roller pair 7 is provided near an end of a conveyance passage. The registration roller pair 7 feeds the recording sheet P toward the transfer area at which the photoconductor 1 faces the transfer device 4.

The transfer device 4 forms a transfer electric field between the recording sheet P fed to the transfer area and the photoconductor 1 to electrostatically move toner from the photoconductor 1 to the recording sheet P. A toner image on the photoconductor 1 is transferred to the surface of the recording sheet P fed into the transfer area by the action of the transfer electric field.

The recording sheet P having passed through the transfer area is fed into the fixing device 32. The recording sheet P fed into the fixing device 32 is heated and pressed in a fixing nip, and the toner image on the surface of the recording sheet P is fixed.

The surface of the photoconductor 1 having passed through the transfer area enters a position opposite to the cleaner 5. The cleaner 5 includes a cleaning member. The cleaning member removes residual toner from the surface of the photoconductor 1. Thereafter, the surface of the photoconductor 1 is uniformly discharged by the discharger 6. The surface of the discharged photoconductor 1 is uniformly charged again by the charger 2 and is ready for the next latent image forming operation.

The recording sheet P having passed through the fixing device 32 is output to the outside of the printer 100 through the output passage 33 and an output nip of the output roller pair 34. The recording sheet P is stacked on the output tray 35 provided outside the printer 100.

Figure 2:
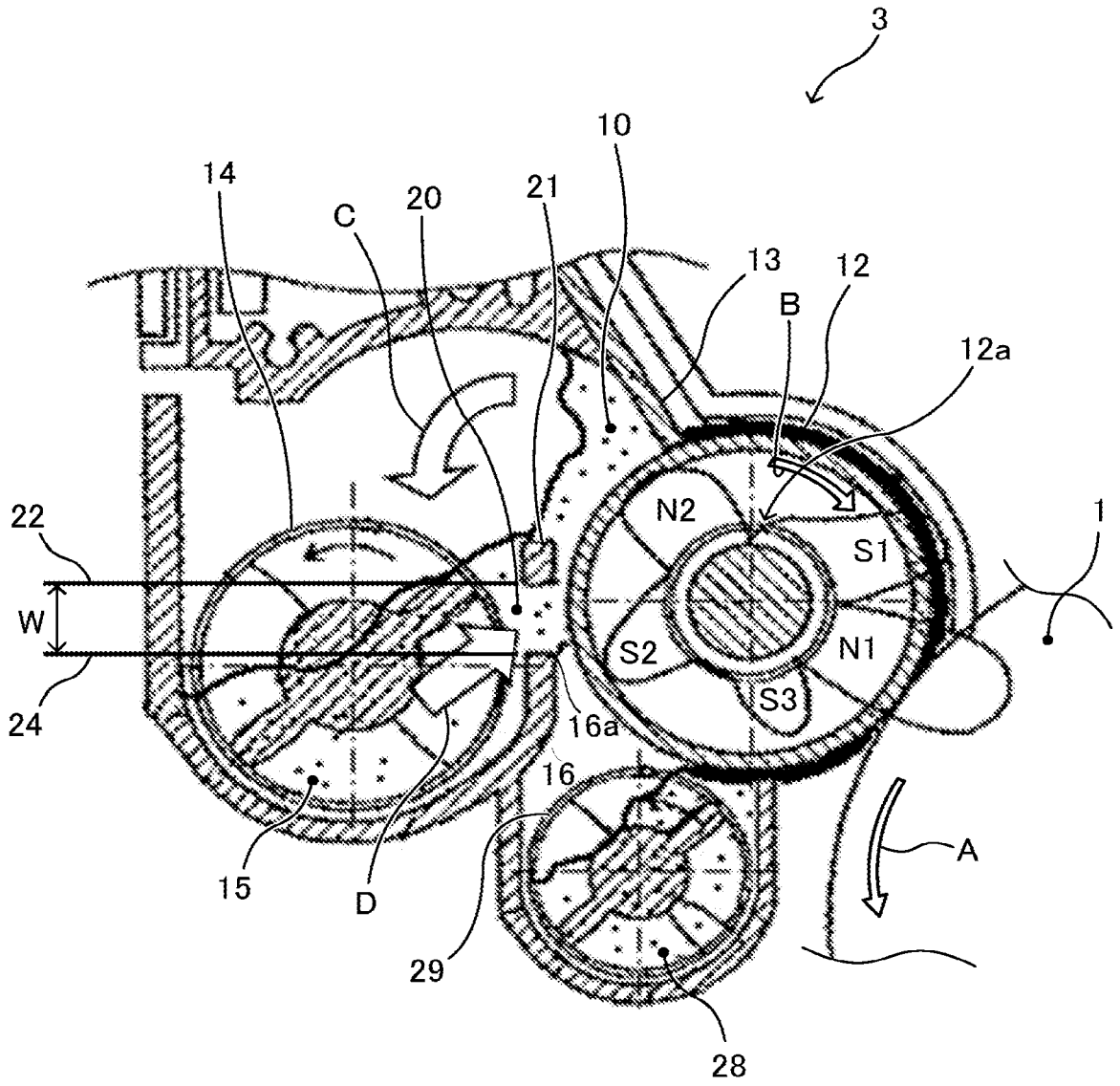
FIG. 2 is an enlarged view of a developing device.

FIG. 2 is an enlarged view of the developing device 3. FIG. 2 is a view from the opposite side of the view of FIG. 1. The developing device 3 includes a non-rotating magnetic roller 12*a* as a magnetic field generator, and a developing roller 12 as a developer bearer. The developing roller 12 rotates with developer 10 containing toner and magnetic carriers borne on the surface of the developing roller 12 by the magnetic force generated by the magnetic roller 12*a*, to convey the developer 10 to a developing area opposite the surface of the photoconductor 1. A developing sleeve of the developing roller 12 is rotated as indicated by arrow B (clockwise in FIG. 2).

The developing device 3 includes a doctor blade 13 as a developer regulator that forms a regulating gap between the surface of the developing roller 12 and the doctor blade 13. The doctor blade 13 regulates the amount of the developer 10 conveyed to the developing area by passing the developer 10 borne on the surface of the developing roller 12 through the regulating gap.

The developing device 3 includes a developer supply passage 15 disposed adjacent to the surface of the developing roller 12. The developer supply passage 15 conveys the developer 10 supplied on the surface of the developing roller 12 along a direction of the rotation axis of the developing roller 12 by a conveying screw 14 as a developer supplying conveyor. The developer supply passage 15 also collects developer 10 that is prevented from passing through the regulating gap by the doctor blade 13 and falls as indicated by arrow C in FIG. 2.

The magnetic roller 12*a* in the developing roller 12 includes at least a developer scooping pole S2 and a developer regulating pole N2. The developer scooping pole S2 generates a scooping magnetic force to draw and scoop the developer 10 in the developer supply passage 15 to the surface of the developing roller 12 beyond an upper end 16*a* of a side wall 16 of the developer supply passage 15 that is opposite to the developing roller 12. The developer regulating pole N2 generates a regulating magnetic force to erect the developer 10 passing the regulating gap. The developer scooping pole S2 and the developer regulating pole N2 are adjacent to each other in a direction of movement of the surface of the developing roller 12 and has opposite polarities to each other. In addition, the developing device 3 includes a developer main pole N1, a developer carrying pole S1, and a developer carrying pole S3 in the developing area.

The developer carrying pole S3 and the developer scooping pole S2 at a lower side of the developing roller 12 are the same magnetism, so that the developer 10 detaches from the surface of the developing roller 12 between the developer carrying pole S3 and the developer scooping pole S2 and falls into a developer collecting passage 28. A conveying screw 29 is disposed in the developer collecting passage 28. In the developer collecting passage 28 and the developer supply passage 15, the developer 10 is conveyed in opposite directions to each other in the axial direction of the developing roller 12. Ends of the developer collecting passage 28 and the developer supply passage 15 are connected to form a developer circulation channel. The developer collecting passage 28 is supplied with toner from a toner supply device as needed.

The developing device 3 includes a stopper 21 that prevents the developer 10, which is prevented from passing through the regulated gap by the doctor blade 13, from moving to the surface of the developing roller 12 along the magnetic lines of the regulating magnetic force, while securing the supply path 20 for passing the developer 10 in the developer supply passage 15 to the developing roller 12 as indicated by arrow D in FIG. 2 at least an entire range of the developing region in the direction of the rotation axis of the developing roller 12 between the stopper 21 and the upper end 16*a* of the side wall 16 of the developer supply passage 15.

A lower end 24 of the supply path 20 coincides with the upper end 16*a* of the side wall 16, as illustrated in FIG. 2. An upper end 22 of the supply path 20 coincides with a lower end of the stopper 21. The width W of the supply path 20 in a direction perpendicular to the direction of the rotation axis of the developing roller 12 is not less than 7% and less than 10% of the circumference of the outer diameter of the developing roller 12. Setting the width W not less than 7% of the outer diameter circumference allows the developer 10 to be sufficiently supplied. The low-density, unmixed developer 10 on is not scooped, Setting the width W less than 10% of the outer diameter circumference prevents low-density, unmixed developer 10 from being scooped from the inner upper side of the conveying screw 14.

Figure 3:
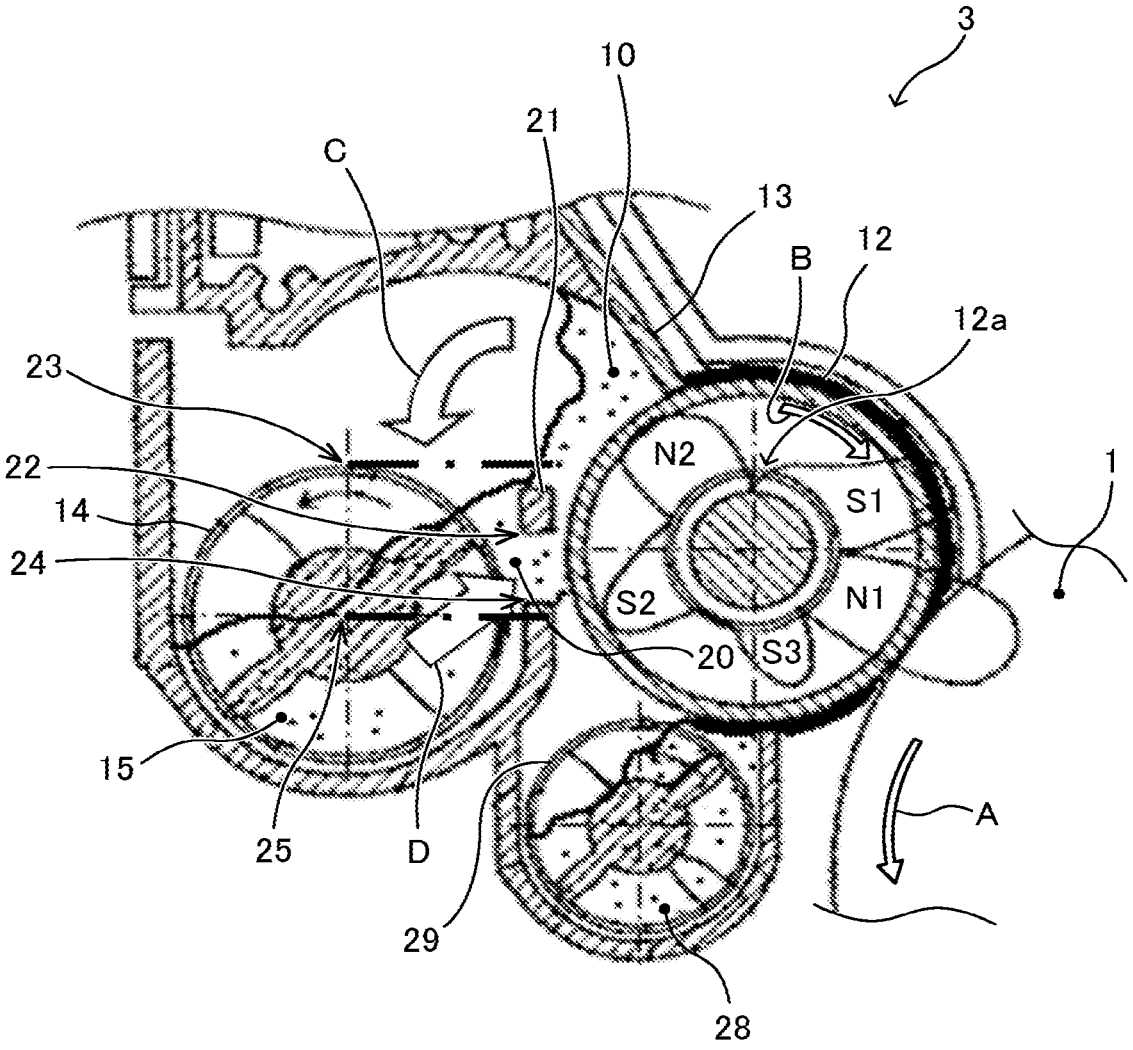
FIG. 3 is another enlarged view of the developing device.

The upper end 22 of the supply path 20 is positioned lower than the height of the upper end 23 of the outer diameter of the conveying screw 14, as illustrated in FIG. 3. Such a configuration can prevent the scooping up of low-density, unmixed developer 10 on the upper side of the conveying screw 14 and further prevent the occurrence of uneven image density. The lower end 24 of the supply path 20 is positioned above a rotation center 25 of the conveying screw 14. Such a configuration can prevent the scooping up of the developer 10 on the lower side of the developer supply passage 15 where uneven density of the developer 10 is caused by blades of the conveying screw 14, and further prevent the occurrence of uneven image density (streaks of auger).

Figure 4:
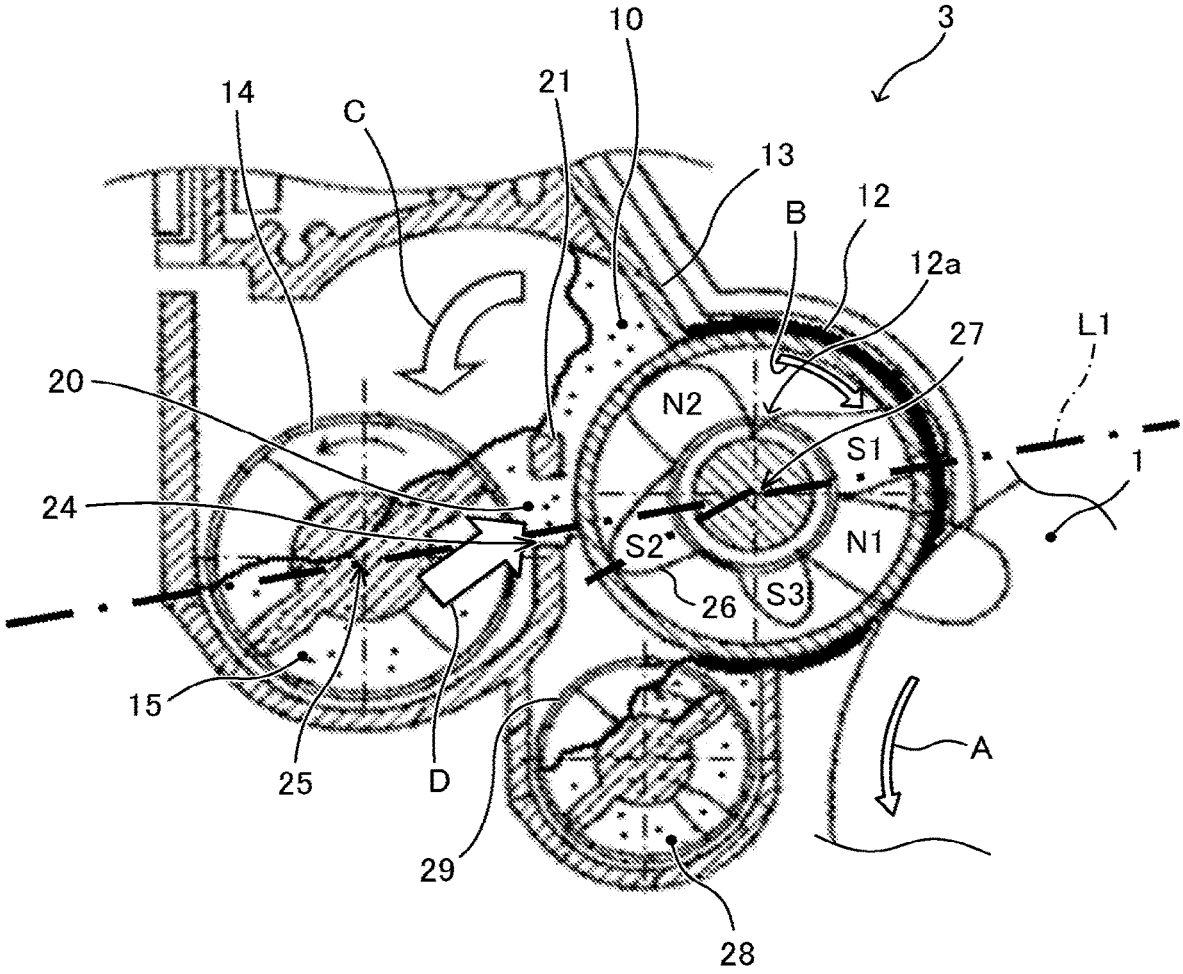
FIG. 4 is still another enlarged view of the developing device.

The peak position of the magnetic flux density in the normal direction of the developer scooping pole (S2) 26 of the developing roller 12 is positioned upstream in the developer conveying direction from a line L1 connecting a rotation center 27 of the developing roller 12 and the rotation center 25 of the conveying screw 14, as illustrated in FIG. 4. The lower end 24 of the supply path 20 is positioned downstream in a rotation direction of the developing roller 12 from the center of the developer scooping pole 26 (a line from the rotation center 27 to the peak position of the magnetic flux density in the normal direction of the developer scooping pole 26). Such a configuration can prevent the scooping up of the developer 10 from the line connecting the rotation center 27 of the developing roller 12 with the rotation center 25 of the conveying screw 14, i.e., a part where the blades of the conveying screw 14 are closest to a developer supply section. Accordingly, the scooping up of the developer 10 in a part where the density of the developer 10 is uneven in a pitch-like manner by the tips of the blades of the conveying screw 14 can be prevented, and the occurrence of uneven image density (streaks of auger) due to the pitch of the blades of the conveying screw 14 can be further prevented.

Table 1 presents experimental results of the ratio (%) of the width W of the supply path 20 to the circumference of the outer diameter of the developing roller 12 and the state of uneven image density. At the ratio of 6%, screw pitch unevenness occurred. At the ratio of 10%, the uneven image density occurred.

TABLE 1

| Ratio of the width of supply passage to the circumference of outer diameter of developing roller | State of uneven image density Very Good > Good > Fair > Bad |
|---|---|
| 6% | Bad (Screw pitch unevenness) |
| 7% | Good |
| 8% | Very Good |
| 9% | Good |
| 10% | Bad |

Table 2 (including Table 2-1 and Table 2-2) presents experimental results of the uneven image density when the ratio (%) of the width of the stopper 21 (the width Y in the direction perpendicular to the rotation axis direction of the developing roller 12, see FIG. 5) to the circumference of the outer diameter of the developing roller 12 in addition to the ratio (%) of the width of the supply path 20 to the circumference of the outer diameter of the developing roller 12.

TABLE 2-1

| | | Width of stopper | | |
|---|---|---|---|---|
| | | 3 mm 3.2% | 6 mm 6.4% | 8 mm 8.5% |
| Width of supply passage | 3 mm 3.2% | Bad (Mottled unevenness) | Bad (Mottled unevenness | Bad (Mottled unevenness |
| | 5 mm 5.3% | Bad (Mottled unevenness) | Bad (Mottled unevenness) | Bad (Mottled unevenness) |
| | 6 mm 6.4% | Bad (Mottled unevenness) | Very good | Very good |
| | 7 mm 7.5% | Bad (Mottled unevenness) | Very good | Very good |
| | 8 mm 8.5% | Bad (Mottled unevenness) | Very good | Very good |
| | 10 mm 10.7% | Bad (Screw pitch unevenness) | Bad (Screw pitch unevenness) | Bad (Screw pitch unevenness) |

TABLE 2-2

| | | Width of stopper | |
|---|---|---|---|
| | | 10 mm 10.6% | 13 mm 13.8% |
| Width of the supply passage | 3 mm 3.2% | Bad (Screw pitch unevenness | Bad (Screw pitch unevenness) |
| | 5 mm 5.3% | Bad (Screw pitch unevenness) | Bad (Screw pitch unevenness) |
| | 6 mm 6.4% | Very good | Bad (White streaks due to solidification over time) |
| | 7 mm 7.5% | Very good | Bad (White streaks due to solidification over time) |
| | 8 mm 8.5% | Good (Slight screw pitch unevenness) | Bad (White streaks due to solidification over time) |
| | 10 mm 10.7% | | |

In Table 2, as in Table 1, there is an appropriate range of the width of the supply passage for the screw pitch unevenness. Specifically, it was confirmed that the screw pitch unevenness occurred when the width of the supply path 20 is not more that 5.3% or not less than 10.7%. As a result, in order to prevent the screw pitch unevenness, the width of the supply path 20 is desirable in a range of 6.4% or more and 10% or less. Depending on the width of the supply path 20 and the width of the stopper 21, it turned out that a "mottled unevenness" which is the uneven image density with mottled pattern occurs. The mottled unevenness deteriorates the image quality, although not as much as the screw pitch unevenness. That is to say, when the width of the stopper 21 is too small, specifically 3.2% or less, the "mottled unevenness" occurred, even though the width of the supply path 20 is in the range of 6.4% or more and 10% or less, which is appropriate from the viewpoint of preventing the screw pitch unevenness. When the width of the supply path 20 is too small, specifically, 5.3% or less, the "mottled unevenness" occurred even when the width of the stopper 21 was 6.4% or 8.5%.

Through diligent studies of the cause of the "mottled unevenness", the inventors have found the following. In a high temperature, high humidity environment, etc., when the fluidity of the developer 10 decreases, the amount of the developer 10 supplied to the developing roller 12 through the supply path 20 becomes small, and the amount of the developer 10 on the developing roller 12 becomes insufficient. Accordingly, the magnetic force of the developing roller 12 attracts the developer 10 from the developer supply passage 15 so that the developer 10 overcomes the upper side of the stopper 21, thus restricting the developer 10, which has been prevented from passing through the regulating gap by the doctor blade 13, from moving back to the developer supply passage 15.

Figure 5A:
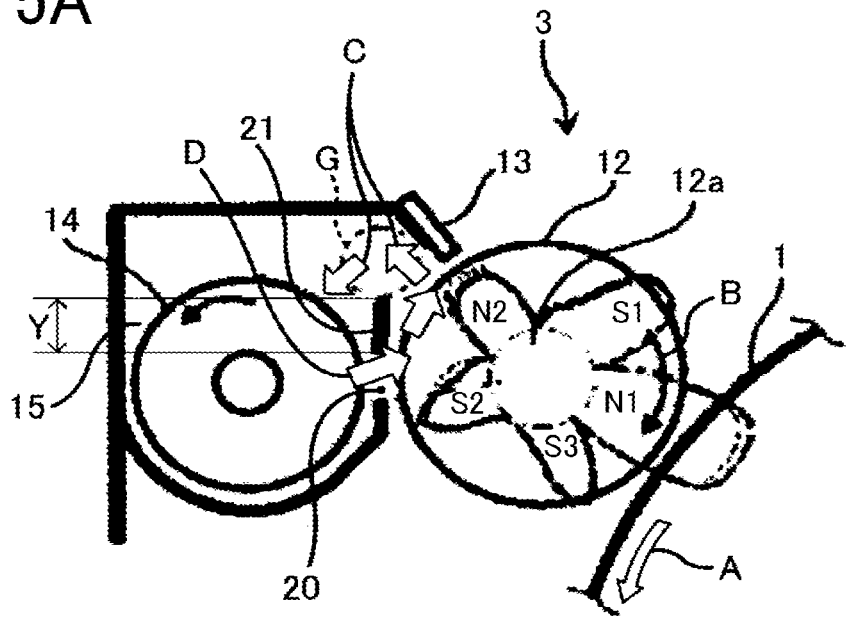
FIGS. 5A and 5B are schematic views illustrating flows of developer in the developing device.
Figure 5B:
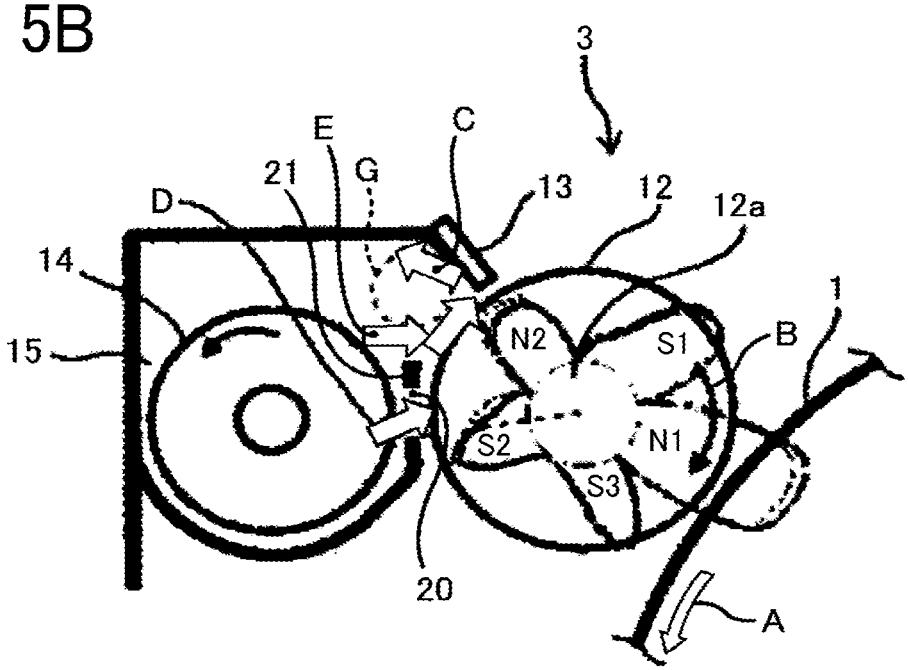

FIG. 5A is a schematic diagram illustrating the movement of the developer 10 in a normal state. FIG. 5B is a schematic diagram illustrating the movement of the developer 10 when the developer 10 is attracted from the developer supply passage 15 to overcome the upper side of the stopper 21. In FIGS. 5A and 5B, only the developer supply passage 15 is illustrated among the developer supply passage 15 and the developer collecting passage 28. Arrow E in FIG. 5B indicates the movement of the developer 10 attracted from the developer supply passage 15 to overcome the upper side of the stopper 21. A broken circle G indicates a retention area of the developer 10 having been prevented from passing through the regulating gap by the doctor blade 13.

The charge amount of toner of the developer 10 retained in the retention area G is high, while the charge amount of toner of the developer 10 just scooped up from the developer supply passage 15 is low. The inventors have found that, because the retained developer 10 and the scooped developer 10 pass through the doctor blade 13 while being mixed, the unevenness of the mixture caused the uneven image density. The movement (arrow E in FIG. 5B) of the developer 10, which is attracted from the developer supply passage 15 to overcome the upper side of the stopper 21, is more likely to occur as the width of the supply path 20 is smaller or the position of the upper end of the stopper 21 is lower.

Figure 6:
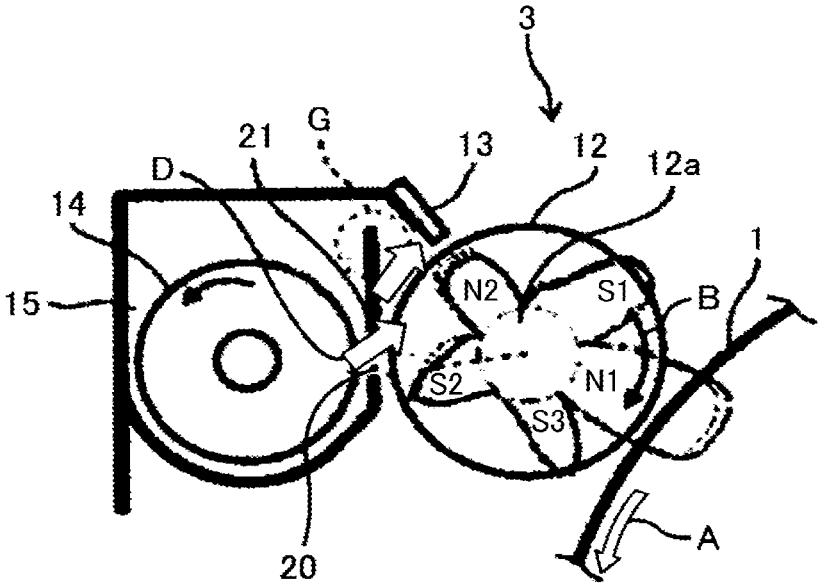
FIG. 6 is another schematic view illustrating a flow of developer in the developing device.

In Table 2, when the width of the stopper 21 is too large, specifically 13.8% or more, an abnormal image of white streaks occurred over time even though the width of the supply path 20 is in the range of 6.0% or more and 10% or less, which is appropriate from the viewpoint of preventing the screw pitch unevenness. As illustrated in FIG. 6, it was because the upper end of the stopper 21 was too high and prevented the developer 10 in the retention area G from circulating in the developer supply passage 15 and thus the developer 10 solidified. Setting the width of the stopper 21 to 11% or less, preferably 10% or less can prevent the circular flow of the developer 10 in the retention area G to the developer supply passage 15.

The defective image of the screw pitch in an upper right area of Table 2 is caused by the high position of the upper end of the stopper 21, the small width of the supply path 20, and the insufficient supply of the developer 10. For the defective image of the screw pitch in a lower left area of Table 2, the position of the upper end of the supply path 20 is too high, and the developer 10 passes through the upper side of the stopper 21 from the retention area G, reaches the upper side of the developer supply passage 15, directly enters the supply path 20, and is borne on the developing roller 12. That is, the defective image is thought to be caused since the stopper 21 cannot fully perform the function of preventing the developer 10 blocked by the doctor blade 13 from moving to the surface side of the developing roller 12.

From the results in Table 2, in order to prevent both the screw pitch unevenness and the mottled unevenness, it is preferable that the width of the supply passage be in the range of 6% or more and 10% or less and the width of the stopper be in the range of 6% or more and 11% or less (more preferably, in the range of 6% or more and 10% or less).

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A developing device, comprising:

a developer bearer including a magnetic field generator and configured to bear a developer containing toner and magnetic carriers, and convey the developer to a developing area by rotation;

a developer supply passage entirely within the rotation area of a conveying screw, the developer supply passage having a side wall that is opposite of the developing bearer;

a developer regulator outside of the developer supply passage;

a stopper positioned between the developer supply passage and the developer regulator and between the developer supply passage and the developer bearer, the stopper configured to prevent the developer blocked by the developer regulator from moving to a surface of the developer bearer; and a supply path for passing the developer in the developer supply passage to the developer bearer, the supply path having a width entirely between the stopper and an upper end of the side wall, wherein a line connecting a center of the developer bearer and a center of the conveying screw does not intersect the sidewall, the width of the supply path is in a direction perpendicular to a direction of a rotation axis of the developer bearer, and the width is in a range of 7% or more and less than 10% of a circumference of an outer diameter of the developing bearer.

2. The developing device according to claim 1, wherein a width of the stopper in the direction perpendicular to the direction of the rotation axis of the developer bearer is in a range of 6% or more and 11% or less of the circumference of the outer diameter of the developing bearer.

3. The developing device according to claim 1, wherein the developer supply passage includes the conveying screw, the conveying screw is configured to supply the developer along the direction of the rotation axis of the developer bearer, and an upper end of the supply path is positioned lower than a height of an upper end of an outer diameter of the conveying screw.

4. The developing device according to claim 1, wherein the developer supply passage includes the conveying screw, the conveying screw is configured to supply the developer along the direction of the rotation axis of the developer bearer, and a lower end of the supply path is positioned above a rotation center of the conveying screw.

5. The developing device according to claim 4, wherein the magnetic field generator includes a developer scooping pole having a magnetic force, the developer scooping pole to scoop the developer beyond the upper end of the side wall, a peak position of a magnetic flux density of the developer scooping pole in a normal direction of the developer bearer is positioned upstream in a developer conveying direction, defined by the rotation of the developer bearer, from a line connecting a rotation center of the developer bearer and the rotation center of the conveying screw, and the lower end of the supply path is positioned above a center of the developer scooping pole.

6. An image forming apparatus, comprising:

a photoconductor; and the developing device according to claim 1.

7. The developing device of claim 1, wherein a width of the stopper in the direction perpendicular to the direction of the rotation axis of the developer bearer is in a range of 6% or more and 10% or less of the circumference of the outer diameter of the developing bearer.

8. The developing device of claim 1, wherein the magnetic field generator includes at least five magnetic poles, the at least five magnetic poles including:

a developer regulating pole facing the developer regulator, a developer scooping pole to draw the developer from the developer supply passage, a developer main pole disposed at the developing area, a first developer carrying pole disposed between the developer regulating pole and the developer main pole, and a second developer carrying pole disposed between the developer main pole and the developer scooping pole.

9. A developing device, comprising:

a developer bearer including a magnetic field generator and configured to bear a developer containing toner and magnetic carriers, and convey the developer to a developing area by rotation;

a developer supply passage entirely within the rotation area of a conveying screw, the developer supply passage having a side wall that is opposite of the developing bearer;

a developer regulator outside of the developer supply passage;

a stopper positioned between the developer supply passage and the developer regulator and between the developer supply passage and the developer bearer, the stopper configured to prevent the developer blocked by the developer regulator from moving to a surface of the developer bearer; and a supply path for passing the developer in the developer supply passage to the developer bearer, the supply path having a first width entirely between the stopper and an upper end of the side wall, wherein a line connecting a center of the developer bearer and a center of the conveying screw does not intersect the sidewall, the first width of the supply path is in a direction perpendicular to a direction of a rotation axis of the developer bearer, the first width is in a range of 6% or more and 10% or less of a circumference of an outer diameter of the developing bearer, and a second width of the stopper in the direction perpendicular to the direction of the rotation axis of the developer bearer is 6% or more and 11% or less of the circumference of the outer diameter of the developing bearer.

10. The developing device according to claim 9, wherein the developer supply passage includes the conveying screw, the conveying screw is configured to supply the developer along the direction of the rotation axis of the developer bearer, and an upper end of the supply path is positioned lower than a height of an upper end of an outer diameter of the conveying screw.

11. The developing device according to claim 9, wherein the developer supply passage includes the conveying screw, the conveying screw is configured to supply the developer along the direction of the rotation axis of the developer bearer, and a lower end of the supply path is positioned above a rotation center of the conveying screw.

12. The developing device according to claim 11, wherein the magnetic field generator includes a developer scooping pole having a magnetic force, the developer scooping pole to scoop the developer beyond the upper end of the side wall, a peak position of a magnetic flux density of the developer scooping pole in a normal direction of the developer bearer is positioned upstream in a developer conveying direction, defined by the rotation of the developer bearer, from a line connecting a rotation center of the developer bearer and the rotation center of the conveying screw, and the lower end of the supply path is positioned above a center of the developer scooping pole.

13. An image forming apparatus, comprising:

a photoconductor; and the developing device according to claim 9.

14. A developing device, comprising:

a developer bearer including a magnetic field generator and configured to bear a developer containing toner and magnetic carriers, and convey the developer to a developing area by rotation;

a developer supply passage entirely within the rotation area of a conveying screw, the developer supply passage having a side wall that is opposite of the developing bearer;

a developer regulator outside of the developer supply passage;

a stopper positioned between the developer supply passage and the developer regulator and between the developer supply passage and the developer bearer, the stopper configured to prevent the developer blocked by the developer regulator from moving to a surface of the developer bearer; and a supply path for passing the developer in the developer supply passage to the developer bearer, the supply path having a width entirely between the stopper and an upper end of the side wall, wherein the magnetic field generator includes at least five magnetic poles, the at least five magnetic poles including:

a developer regulating pole facing the developer regulator, a developer scooping pole to draw the developer from the developer supply passage, a developer main pole disposed at the developing area, a first developer carrying pole disposed between the developer regulating pole and the developer main pole, and a second developer carrying pole disposed between the developer main pole and the developer scooping pole, the width of the supply path is in a direction perpendicular to a direction of a rotation axis of the developer bearer, and the width is in a range of 7% or more and less than 10% of a circumference of an outer diameter of the developing bearer.

* * * * *